United States Patent [19]

Reynes

[11] Patent Number: 4,476,784

[45] Date of Patent: Oct. 16, 1984

[54] ANTI-TANK MINE

[75] Inventor: Jean-Pierre Reynes, Toulouse, France

[73] Assignee: Societe E. LaCroix-Tous Artifices, Muret, France

[21] Appl. No.: 385,717

[22] Filed: Jun. 7, 1982

[51] Int. Cl.[3] ..... F24B 23/28

[52] U.S. Cl. ..... 102/428; 102/424

[58] Field of Search ..... 102/428, 429, 424, 401, 102/254, 255

[56] References Cited

U.S. PATENT DOCUMENTS

| | | | |
|---|---|---|---|
| 2,555,318 | 6/1951 | Christensen | 102/428 |
| 3,282,212 | 11/1966 | Romano | 102/428 |

FOREIGN PATENT DOCUMENTS

| | | | |
|---|---|---|---|
| 427862 | 5/1938 | Belgium . | |
| 1404933 | 5/1965 | France . | |
| 2357860 | 2/1978 | France | 102/428 |
| 2393261 | 2/1979 | France | 102/428 |

*Primary Examiner*—Charles T. Jordan

*Attorney, Agent, or Firm*—McCormick, Paulding & Huber

[57] ABSTRACT

The present invention relates to a mine incorporating a pressure plate. Such a mine comprises, inter alia, a pressure plate, a pyrotechnic firing chain and an arming device. The pyrotechnic chain comprises a firing relay rotatably mobile in two substantially perpendicular directions to ensure alignment of the pyrotechnic chain by a double rotation of a support disc about a shaft and a mobile member about an axis. Maneuvering of an arming button ensures rotation of the mobile member; a clockwork timer device ensures rotation of the support disc. A further feature of the invention resides in the reversibility of arming, the opposite maneuver of the arming button ensuring that the mobile elements of the mine return to their intial position. In addition, an anti-blast device is incorporated in the pressure plate. The invention is applicable to anti-tank mines.

10 Claims, 7 Drawing Figures

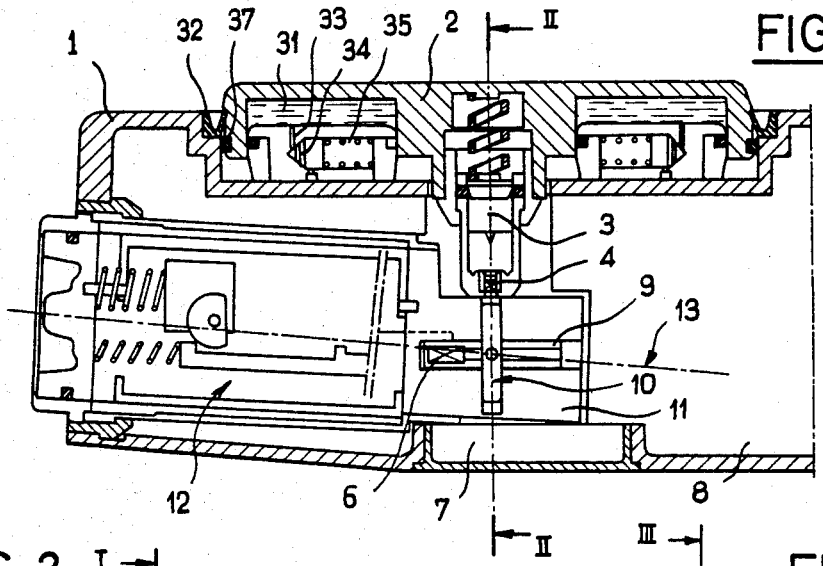
FIG_1
FIG_2
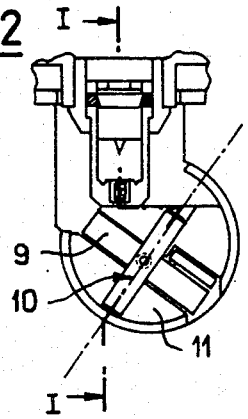
FIG_4
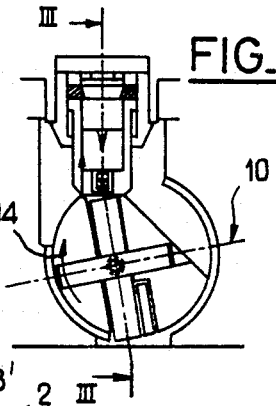
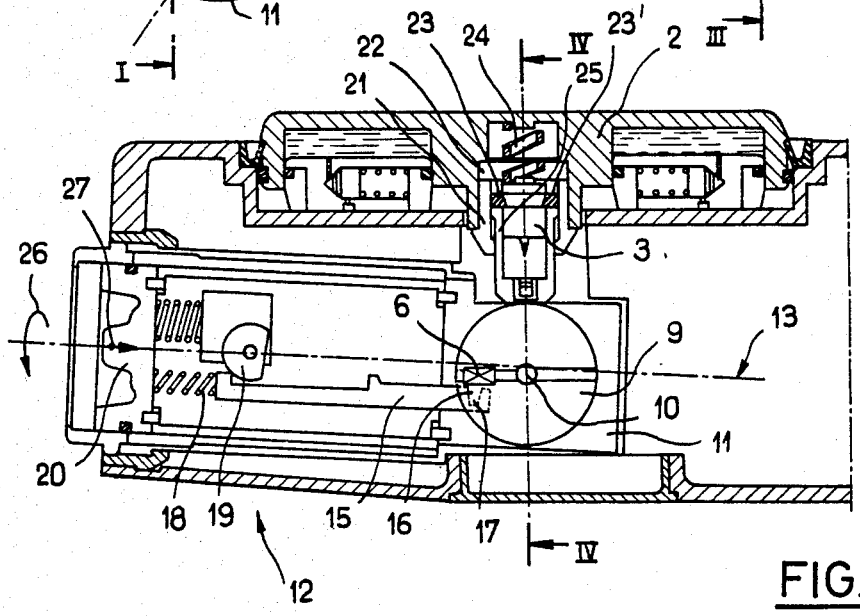
FIG_3

FIG_5
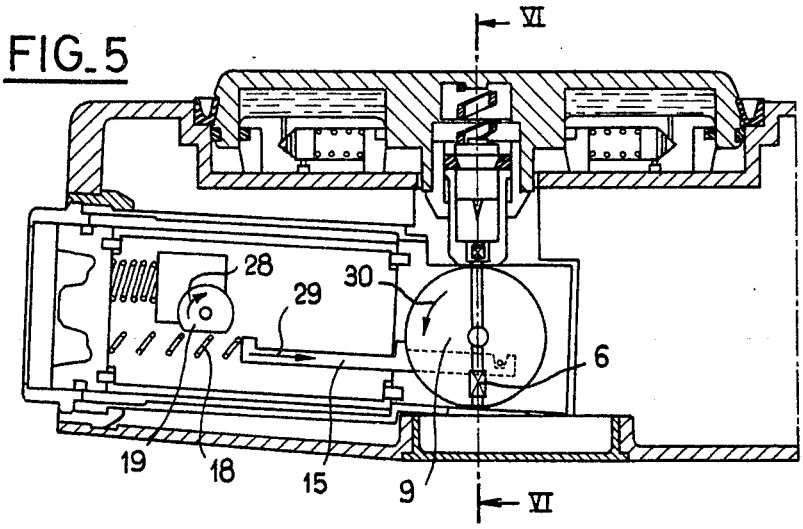
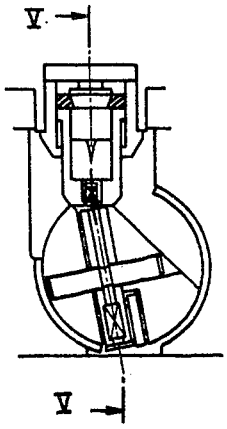
FIG_6
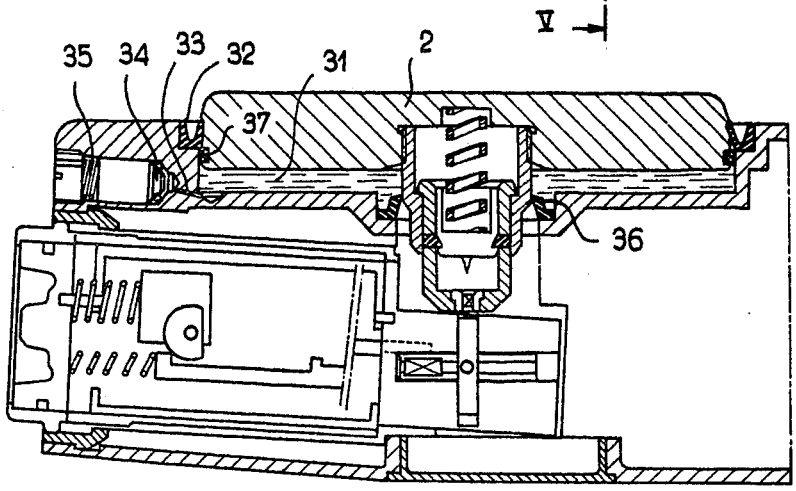
FIG_7

ANTI-TANK MINE

The present invention relates to an anti-tank mine constituted by a pyrotechnic firing and fire transmission chain, a useful explosive charge and by an arming device, contained in a casing provided in its upper part with a pressure plate ensuring triggering of the mine.

In a manner known per se, the pyrotechnic firing and fire transmission chain is constituted by a striker, a primer, a firing relay and a firing unit. In the so-called arming position, the continuity of the pyrotechnic chain is ensured by the alignment of all these elements. In the so-called stored position, the alignment is interrupted and continuity is no longer ensured. This arrangement may be lacking in safety, particularly in the event of passage from the stored position to the so-called armed position being effected directly by manoeuvring a simple outside control.

The present invention proposes an anti-tank mine where the passage from the stored position to the armed position is effected via an intermediate so-called pre-arming phase where a time switch device triggered by manoeuvring an outside control will bring the chain into alignment after a given time, without outside intervention. The mine also presents the particular feature of being reversible, i.e. simply by manoeuvring the outside control in the opposite direction, the mine can be returned to its initial stored position.

It is characterised in that the firing relay is mounted on a disc mobile in rotation about a shaft, said shaft being borne by a member itself mobile in rotation about an axis substantially perpendicular to the shaft of the mobile disc, and said relay being adapted to ensure alignment of the pyrotechnic chain by a double rotation of the disc about the shaft and of the member about the axis, the previous rotation of the member ensuring alignment of the plane of the disc with the upstream part and the downstream part of the pyrotechnic chain, and the subsequent rotation of the disc ensuring the alignment of the firing relay with these same elements of the chain.

In a preferred embodiment, the mobile disc cooperates to push the finger so as to provoke rotation of the disc, said finger being immobilised by a blocking cam itself actuated by a clockwork device activated by manoeuvring an arming button fast with the mobile member.

The invention will be more readily understood on reading the following description with reference to the accompanying drawings, in which:

FIG. 1 shows a section of the mine in the stored position, along line I—I of FIG. 2, FIG. 2 is a section along line II—II of FIG. 1, FIG. 3 shows a section through the mine in the pre-armed position, along line III—III of FIG. 4, FIG. 4 is a section along line IV—IV of FIG. 3, FIG. 5 is a section through the mine in the armed position, along line V—V of FIG. 6, FIG. 6 is a section along line VI—VI of FIG. 5, and FIG. 7 shows a variant embodiment of FIG. 1.

Referring now to the drawings, FIGS. 1 and 2 show all the elements of the anti-tank mine in the stored position. This mine is constituted by a casing 1 provided in its upper part with a pressure plate 2 adapted to provoke firing by ignition of a pyrotechnic chain constituted by a striker 3, a primer 4, a firing relay 6 and a firing unit 7 enabling the useful pyrotechnic charge 8 contained in the mine to be fired. It will be noted that, in FIG. 1, the relay 6 is in a position interrupting the chain, preventing priming of the mine. This relay is borne by a mobile disc 9 (seen in profile in FIGS. 1 and 2) pivoting about its shaft 10, this shaft itself being borne by a member 11 cooperating with the arming device 12, and mobile about an axis 13, the shaft 10 and axis 13 being perpendicular or substantially perpendicular, so that the axis 13 is approximately in the plane of the disc 9. In a section perpendicular to its axis of rotation, as may be seen more particularly in FIG. 2, the member 11 is in such a form as to enable it to perform the role of a cam, the functioning of which will be described hereinafter.

FIG. 3 shows the disc 9 in plan view and the arming device 12 in detail. With respect to FIG. 1, the mobile member 11 has pivoted through about 45° in the direction of arrow 14 about axis 13; the disc 9 which the member 11 supports and the arming device 12 have pivoted at the same time as said member.

Said arming device is constituted by a finger 15 mobile in translation and adapted, in its movement, to rotate the disc 9 about the shaft 10, for example via a notch 16 driving a lug 17 fast with the disc 9. This manoeuvring finger is repelled by a spring 18 tending to provoke rotation of the disc 9 about the shaft 10. A blocking cam 19, actuated by a clockwork delay device (not shown), may, depending on its position, immobilise the finger 15 or release it to allow the spring 18 to slacken. An arming button 20 enables the mine to be armed by outside action. This button is mobile in rotation about axis 13, thus ensuring rotation of the member 11, and in translation parallel to axis 13.

The firing device is composed of the pressure plate 2 capable of being driven in a controlled manner, which will be described hereinbelow, a connecting piece 21 fastened with the plate, a primer-holder 25, sliding in the connecting piece 21, the striker 3 sliding in the primer-holder 25 and maintained therein via two pins 23 and 23', and a spring 24 positioned between the lower face of the plate 2 and the striker 3. The plate is maintained in high position by an elastic lipped ring 32.

To pass from the storage position (FIGS. 1 and 2) to the so-called pre-arming position (FIGS. 3 and 4), the operator exerts on the button 20 a double movement of rotation (about 45° in the direction of arrow 26) and of driving in (about 7 mm in the direction of arrow 27).

Rotation causes the member 11 to pivot in the direction of arrow 14, and consequently the plane of the disc 9 to be aligned with the downstream part and the upstream part of the pyrotechnic chain. However, the relay 6 is not yet aligned, rendering firing impossible. The cam-shaped section of the member 11, visible in FIGS. 2 or 4, makes it possible, by rotation, to raise the primer support 25 and the striker 3, thus effecting compression of the spring 24 and tensioning of the striker.

By the consecutive rotation and driving in of the button, the clockwork timer is activated and the spring 18 is tensioned.

The latter, after a predetermined time, which may be of the order of 10 to 25 minutes, will cause the mine to pass into the arming position, shown in FIGS. 5 and 6. The timing mechanism provokes rotation of the cam 19 in direction 28, which releases the manoeuvring finger 15. The latter, repelled by the spring 18 in direction 29, provokes pivoting of the disc 9 in direction 30. The alignment of the firing relay 6 with the other elements of the pyrotechnic chain is thus effected, allowing firing and firetransmission.

A ratchet mechanism enables the button to be immobilised in the armed position.

One of the features of the invention resides in the reversibility of the arming, by inverse manoeuvre of the button 20. Rotation in the direction opposite to arrow 26 interrupts the chain by pivoting of the member 11, the return into the low position of the primer support 25 and therefore the slackening of the spring 24, as well as withdrawal of the finger 15, for example by means of a lug fast with the finger actuated by a ramp formed in the body of the mine (not visible in the Figures). The withdrawal of the finger provokes rotation of the disc 9 in the opposite direction and therefore the return to the original position. Finally, the withdrawal of the button 20 in the direction opposite to arrow 27 returns the timing mechanism to zero, this blocking the finger 29 by rotation of the cam 19.

An anti-blast device is associated with the firing system triggered by pressure. As may be seen in FIG. 1 or FIG. 7 which shows a variant embodiment, the pressure plate 2 is provided in its lower part with a cavity 31 forming a pressure chamber and filled with a fluid. An O-ring 37 encircling the plate ensures tightness. The pressure chamber communicates with the outside via at least one calibrated orifice 33 obturated by a valve 34 retained by a spring 35. The plate is fast with the connecting piece 21 mentioned above.

FIG. 7 shows a variant embodiment, operating according to the same process, where the fluid flows directly to the outside through a single orifice. Tightness on the inner diameter is obtained by a lipped seal 36.

A variant of the invention may consist in using air as fluid filling the pressure chamber 31.

When a pressure is exerted on the plate 2, the valve is repelled, allowing the fluid to flow towards the outside through the calibrated orifice. This device allows the plate to be progressively driven in and avoids triggering of the mine by simple percussion or by the blast of an adjacent explosion. At the end of its stroke, the plate has lowered the connecting piece 21 with respect to the primer support 25 until the pins 23 and 23' come level with the groove 22, thus releasing the striker 3 which, by the spring 24 slackening, strikes the primer 4. Fire is transmitted by the relay 6 up to the firing unit 7.

All the pieces constituting the mine are preferably made of non-metallic material so that the mine is undetectable by metaldetectors.

The mine is also preferably provided with portions in relief and with recesses allowing automated positioning by mechanical machines.

The present description has of course been given only by way of non-limiting example and numerous variants may be envisaged without departing from the scope of the invention.

I claim:

1. An anti-tank mine having a casing, a pressure plate, a pyrotechnic firing and fire transmission chain constituted by a striker, a primer, a firing relay and a firing unit, a useful explosive charge, and an arming device, and comprising an improvement wherein the firing relay is mounted on a disc mobile in rotation about a shaft, said shaft being borne by a member itself mobile in rotation about an axis substantially perpendicular to the shaft of the mobile disc, and said relay being adapted to ensure alignment of the pyrotechnic chain by rotation of the disc about the shaft and rotation of the member about the axis, the rotation of the member ensuring alignment of the plane of the disc with the upstream part and the downstream part of the pyrotechnic chain, and the rotation of the disc ensuring alignment of the firing relay with these same elements of the chain.

2. The anti-tank mine of claim 1, wherein the mobile disc cooperates with a drive finger mobile in translation, abutting on a spring tending to repel the finger so as to provoke rotation of the disc, said finger being immobilised by a blocking cam itself actuated by a clockwork device activated by manoeuvring an arming button.

3. The anti-tank mine of claim 2, wherein the arming button is fastened with the mobile member and is capable, in its movement, of rotating said member.

4. The anti-tank mine of claim 3, wherein the mobile member presents, in a section perpendicular to its axis of rotation, the form of a cam abutting on a primer support whose displacement, by the rotation of the mobile member, ensures compression of a spring for tensioning the striker.

5. The anti-tank mine of claim 2, 3 or 4, wherein the arming button is capable, by being manoeuvred in opposite direction, of ensuring opposite rotation of the mobile member and opposite rotation of the mobile disc, so as to ensure that the mobile elements of the mine return to their initial position, by interruption of the pyrotechnic chain and de-activation of the clockwork device.

6. The anti-tank mine of claim 1, wherein the alignment of the plane of the disc is obtained by a rotation through about 45° of the mobile member, and the alignment of the firing relay is obtained by a rotation through about 90° of the mobile disc.

7. The anti-tank mine of claim 1, wherein the pressure plate cooperates with a damping device, so as to allow the mine to operate only under the effect of a pressure maintained on said plate for a period of time greater than a given duration.

8. The anti-tank mine of claim 7, wherein the damping device is constituted by a pressure chamber containing a fluid adapted to escape from said pressure chamber under the effect of the pressure maintained on the plate, and via a calibrated orifice obturated by a closure valve in the absence of pressure exerted on the plate.

9. The anti-tank mine of claim 8, wherein the pressure chamber is constituted by the volume between the lower face of the pressure plate and the part of the upper face of the casing opposite the plate, tightness between these two pieces being ensured by an O-ring encircling the pressure plate.

10. The anti-tank mine of one of claims 8 or 9, wherein the fluid contained in the pressure chamber is air.

* * * * *